US006176046B1

(12) United States Patent
Quine et al.

(10) Patent No.: US 6,176,046 B1
(45) Date of Patent: Jan. 23, 2001

(54) PORTABLE, PRE-MANUFACTURED, MODULAR NATURAL GAS DELIVERY STATIONS

(75) Inventors: Thomas G. Quine, Methuen; John E. Rafferty, Lowell; James M. Hunt, Methuen; James M. Smilikis, Georgetown, all of MA (US)

(73) Assignee: Northstar Industries, Inc., Andover, MA (US)

( * ) Notice: Under 35 U.S.C. 154(b), the term of this patent shall be extended for 0 days.

(21) Appl. No.: 09/198,269

(22) Filed: Nov. 24, 1998

(51) Int. Cl.[7] ..... F17D 1/04

(52) U.S. Cl. ..... 52/79.1; 52/79.5; 52/79.9; 52/220.2; 52/745.02; 52/745.2; 290/1 A; 290/1 R; 48/190

(58) Field of Search ..... 52/79.1, 79.4, 52/220.2, 745.01, 745.02, 79.5, 79.9, 745.2, 750; 290/1 A, 1 R; 48/190

(56) References Cited

U.S. PATENT DOCUMENTS

| | | | | |
|---|---|---|---|---|
| Re. 30,280 | | 5/1980 | Berman et al. . | |
| 3,690,077 | | 9/1972 | Dalgliesh, Jr. et al. . | |
| 3,925,679 | * | 12/1975 | Berman et al. | 290/1 A |
| 4,136,432 | * | 1/1979 | Meely | 290/1 A |
| 4,539,844 | | 9/1985 | Grove, Jr. . | |
| 4,658,634 | | 4/1987 | Killough et al. . | |
| 4,666,340 | | 5/1987 | Cox . | |
| 4,763,451 | | 8/1988 | Butcher . | |
| 4,788,802 | | 12/1988 | Wokas . | |
| 5,265,384 | | 11/1993 | Menke et al. . | |
| 5,353,558 | | 10/1994 | Shea, Sr. et al. . | |
| 5,628,191 | * | 5/1997 | Kueck et al. | 60/655 |
| 5,644,871 | | 7/1997 | Cohen et al. . | |
| 5,656,491 | * | 8/1997 | Cassani et al. | 52/79.1 |
| 5,727,353 | * | 3/1998 | Getz et al. | 52/79.1 |

* cited by examiner

*Primary Examiner*—Robert Canfield
(74) *Attorney, Agent, or Firm*—Shinjyu Global IP Counselors, LLP

(57) ABSTRACT

A pre-manufactured natural gas delivery station is presented to a client that filters, measures, controls, pre-heats, pressure reduces, odorizes, and provides communication, provides excess power, and provides excess heat for a host site. The design is pre-approved by supply pipeline, end users and regulatory bodies. The final configuration is welded, assembled, wired, painted, tagged, and tested, at a factory site and then shipped to an installation site in accordance with customer's requirements. The station is commissioned, operators are trained and a three volume project DATA book is installed in the control room for documentation. The pre-manufactured natural gas delivery station can include a high pressure gas metering room and regulating room that can be selectively coupled to other prefabricated modular rooms or modules. Preferably, the other prefabricated modules include an odorant room, a heating room, an energy generation room and an electrical control and communications room. The equipment and control systems for each room is preinstalled and secured to the building structure in each of the different modules at the factory site. The energy generation room and the electrical control room allows the gas metering station to be operated by electrical energy from a local utility line or from an internal generator that is fueled by the gas being metered.

45 Claims, 7 Drawing Sheets

PORTABLE, PRE-MANUFACTURED, MODULAR NATURAL GAS DELIVERY STATIONS

BACKGROUND OF THE INVENTION

1. Field of the Invention

This invention generally relates to portable pre-manufactured modular natural gas delivery stations. More specifically, the present invention relates to prefabricating modular units that are combined to form a pre-manufactured natural gas delivery station at a power plant, gas distribution company or an industrial site. This invention utilizes separate stand alone or combined rooms. There is a high pressure gas metering and regulating room, an odorization room, a glycol heater room, a data acquisition and control room and a co-generation room. This entire code compliant and pipeline approved facility can be placed upon an ⅛ of an acre and cost less than half of the cost of previous facilities of similar size.

2. Background Information

Natural gas is a widely used source of energy throughout the world. For example natural gas is widely utilized in many countries for power generation, heating and/or cooking. Natural gas is often transported via high pressure (e.g., 1440 psig) natural gas pipelines to various gas delivery stations or distribution points around a country. The gas from the natural gas pipeline is typically measured, odorized and controlled by a utility company or a natural gas distributor, and then the gas is distributed by the utility company or distributor to the customers at pressures as low as 7" of water column. In addition, the gas must be preheated prior to pressure reduction. There is a specific reason for this pre-heat. When decompression takes place heat loss occurs at a rate of seven degrees F. of heat loss for each 100 psi of decompression. For example, gas delivered at 35 degrees F. and 600 psig would drop in temperature to 0 degrees F. If the pressure were dropped to 100 psig and no preheat was applied this could cause equipment failures or frost heaves in earth around a buried pipeline.

Deregulation of the Energy Sector and Clean Air Policies have created an unprecedented demand for new interconnects to be installed within the Natural Gas Transmission systems throughout the world. The vast amount of new interconnects, both in the inner cities and remote rural locations, and limited resources of various companies have created a need for a complete, portable, low profile, quiet, code compliant, insurance compliant, environmentally friendly, pre-approved solution to the complex interconnection to a gas transmission pipeline.

At each of these distribution points, typically there is a natural gas city gate station or natural gas delivery station that is the delivery point of natural gas from the pipeline to its customers. In the past, the gas companies utilized in-house expertise for engineering and project management of the new city gate stations. However, deregulation and clean air regulations have created situations that have resulted in shortage of in house expertise. In particular, deregulation has forced many companies to downsize their staffs to a point where much of the in-house talent is gone. Moreover, traditional college curriculums do not educate new graduates adequately in the uniqueness of compressible fluid dynamics, and other properties of natural gas. Demand in the use of natural gas has created an unprecedented demand for new interconnects. Accordingly, new companies have entered the marketplace who are unfamiliar with the engineering, and regulatory requirements of the natural gas industry.

In the past, these natural gas city gate stations were typically constructed completely on site from scratch. Each of the natural gas city gate stations tend to be slightly different depending upon the utilities needs and/or desires and the pipeline company needs and/or desires. However, most natural gas city gate stations typically have certain common equipment that is needed to accomplish the desired tasks of metering, regulating, preheating, odorizing and controlling of the high pressure gas pipelines. These natural gas city gate stations often include a metering building, a regulating building, a data acquisition control building, an odorant building and a heating area. Because these natural gas metering stations are typically constructed completely on site from scratch, they often are quite expensive and time consuming to construct.

Moreover, these natural gas city gate stations were constructed of several separated buildings. This was mainly due to the fact that the pipeline company would own certain equipment and buildings and the utility company and/or distributor would own certain other equipment and buildings.

Construction of these natural gas city gate stations can be complicated by the fact that sometimes these stations are located in exclusive neighborhoods that are sensitive to noise, odor, hazardous waste, air quality and aesthetics or in remote rural areas. This increases the difficulty in economically and rapidly constructing natural gas city gate station. In addition, natural gas city gate stations that are located in rural areas are more frequently prone to power outages and are difficult to service during power outages.

Design and construction of these natural gas city gate stations can be further complicated by the fact that a supplier and end user must conceptualize this new interconnect, develop operating agreements, develop lines of responsibility, locate land, secure permitting, for a large, noisy, visible and smelly site.

In view of the above, there exists a need for a method of prefabricating modular units for forming a natural gas delivery station, which overcomes the above mentioned problems in the prior art. Moreover, there exists a need for a natural gas delivery station that can produce its own electrical energy. This invention addresses these needs in the prior art as well as other needs, which will become apparent to those skilled in the art from this disclosure.

SUMMARY OF THE INVENTION

One object of the present invention is to create a pre-manufactured, portable, modular, single building, innovative approach that combines filtering, metering, preheating, pressure regulation, flow control, odorization, electrical power distribution, electronic control, gas analysis, backup power, can provide excess power to a host site, and can provide excess heat to a host site. The invention illustrates a portable pre-manufactured single building innovative approach.

One object of the present invention is to provide a pre-manufactured natural gas delivery station that can be manufactured in accordance with customer specifications and then shipped to the installation site as a completed unit.

Another object of the present invention is to provide a pre-manufactured natural gas delivery station that reduces the on-site installation time and costs.

Another object of the present invention is to provide a natural gas delivery station that is more economical to manufacture than prior art natural gas delivery stations.

Still another object of the present invention is to provide a pre-manufactured natural gas delivery station that can generate its own electricity from the gas being metered therethrough.

Still another object of the present invention is to provide pre-manufactured natural gas delivery station that can operate either utilizing electrical energy from an electrical power line or from the gas being metered therethrough.

Another object of this invention is to implement a project approach that allows for a pre-approval from pipelines, the Federal Energy Regulatory Commission (FERC), end users, local, county and state regulatory bodies. The present invention utilizes a pre-manufactured or standardized approach in which the plans, documentation, and specifications for all of the rooms or modules can be quickly submitted to and approved by the necessary parties. This allows for a fast pre-approval of the natural gas delivery from pipelines, the Federal Energy Regulatory Commission (FERC), end users, local, county and state regulatory bodies.

Another object is to eliminate large in line heaters which use thousands of gallons of ethylene glycol, and which are low efficiency, noisy, and difficult maintenance. The present invention accomplishes this objective by using remote heaters that are located within a specially designed building. Preferably, low reservoir propylene glycol heaters are used along with shell and tube heat exchangers. This eliminates the need for large in line heaters. By placing the heaters inside a building, the noise to the surrounding area is reduced. Moreover, emissions are contained within the building and can be filtered.

Another object of the invention is to decrease the visibility of this facility. The low profile design decreases the visibility of this facility and thus, can be more readily concealed from the surrounding community.

Another object of the invention is to decrease the noise of this facility. Noise attenuation, acoustical panels, and low noise heaters are used in the buildings to decrease the noise of this facility to less than 40 DBA at the property lines.

Another object of the invention is to decrease site size requirements. In the prior art facilities, the various buildings are separated from each other. The single building station of the present invention decreases land use to approximately ⅛ of an acre.

Another object of the invention is to eliminate odors and noise during operation of the natural gas delivery station. By building the natural gas delivery station at the factory site, certain construction techniques can be used which are not suitable for construction at the installation site. For example, special welding techniques can be used that prevent odors leaking out of the piping during operation of the natural gas delivery station.

Another object of the invention establishes a cost sharing mechanism between pipelines and end users. The benefit of such a design can make cost sharing very acceptable.

Another object of the invention is to decrease project cost. The combined facility can be one half the cost of the traditional pipeline interconnects.

Another object of the invention is to utilize approved designs in measurement, hazardous area classifications and equipment selection that will simplified approval from pipelines, regulators and insurance inspectors. American Gas Association (AGA) approved designs in measurement, hazardous area classifications and equipment selection can be used in the natural gas delivery station, which simplified approval from pipelines, regulators and insurance inspectors.

Another object of the invention is to develop a solution that helps expand the use of gas and is repeatable. The invention helps expand the use of gas with ease of new interconnects and seems exceptionally attractive for new power plant feeds as well as new franchises.

Another object of the invention is to be able to use each room or module of the present invention independently or together. Each room of the design can stand alone. For example the odorant room can serve as a mainline odorizer. The heater room can be utilized to replace inline heaters.

Another object of the invention is to use the invention in other applications relating to liquefied natural gas, or propane systems. The present invention has other uses in the energy business. The invention can be put on a site with liquefied natural gas storage tanks or propane storage tanks and provide a complete system for measuring, heating, odorizing, controlling, the process for a remote feed.

This invention is intended to provided a cost effective, environmentally benign, low visibility, small footprint, alternative to traditional pipeline interconnects. These traditional natural gas interconnects from the high pressure pipeline facilities traditionally have consisted of as many as five buildings and covered several acres of land.

In accordance with one aspect of the present invention, a method of pre-manufacturing a natural gas delivery station is carried out by performing the following steps: prefabricating at a factory site a high pressure gas metering and regulating room having high pressure gas piping with a gas inlet adapted to be coupled to a first gas transmission line and a gas outlet adapted to be coupled to a gas distribution line; prefabricating at the factory site a predetermined set of modular buildings that are configured to be coupled to the high pressure gas metering and regulating room; combining at the factory site the high pressure the gas metering and regulating room with at least one of the predetermined set of modular buildings at the factory site to form a customer selected gas delivery station; and shipping the customer selected gas delivery station from the factory site to a customer installation site, which is remote from the factory site.

In accordance with this method of the present invention, the customer can select predetermined set of modular buildings or rooms, which preferably includes a gas metering and regulating room, an odorant room, a boiler room, a energy generation room and an electrical and control room. Of course, other modules or rooms can be included in the predetermined set of modular buildings from which the customer can create the high pressure gas delivery station. Moreover, it is possible that a room or module can be constructed which is not one of the prefabricated rooms or modules. In other words, the customer can have a high pressure gas delivery station that includes both the prefabricated rooms or modules and completely customized rooms or modules. The prefabricated rooms or modules are typically outfitted such that certain basic equipment is built into all similar prefabricated rooms or modules. Of course, additional custom features can be added to the basic pre-manufactured rooms or modules at the factory site as needed and/or desired by the customer.

In accordance with another aspect of the present invention, a gas delivery station is provided with co-generation of electrical energy. Basically, the gas delivery station has a high pressure gas metering and regulating room, a generation room and a dual power control unit. The high pressure gas metering and regulating room has high pressure gas piping with a gas inlet adapted to be coupled to a first gas transmission line and a gas outlet adapted to be coupled to a second gas distribution line. The high pressure gas piping has a high pressure gas metering unit and gas regulating equipment and a gas heat exchanger coupled between the gas inlet and the gas outlet. The generation room is provided with a gas operated generator having a gas conduit fluidly coupled to the high pressure gas piping so that the generator is powered by the natural gas being metered. The dual power control unit is electrically coupled to the gas operated generator to receive electrical energy therefrom and configure to be electrically coupled to an electrical utility line for receiving electrical energy therefrom.

The gas delivery station of this aspect of the present invention further includes an odorant room, a boiler room and an electrical control room. These rooms are constructed as module that are fixedly coupled together to form a single integrated building.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENT

Figure 1:
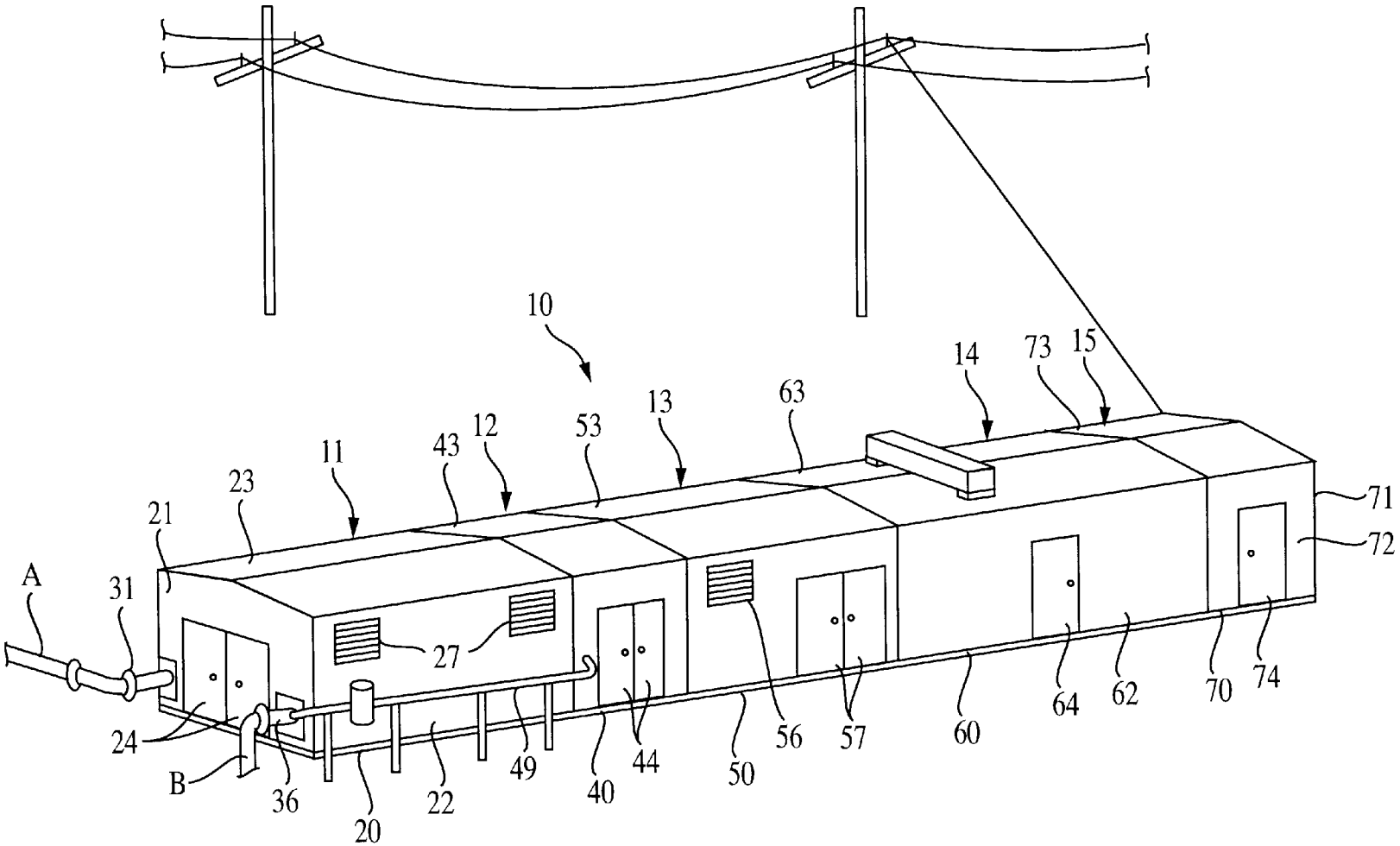
FIG. 1 is a perspective view of a pre-manufactured gas delivery station installed at an installation site in accordance with the present invention.
Figure 2:
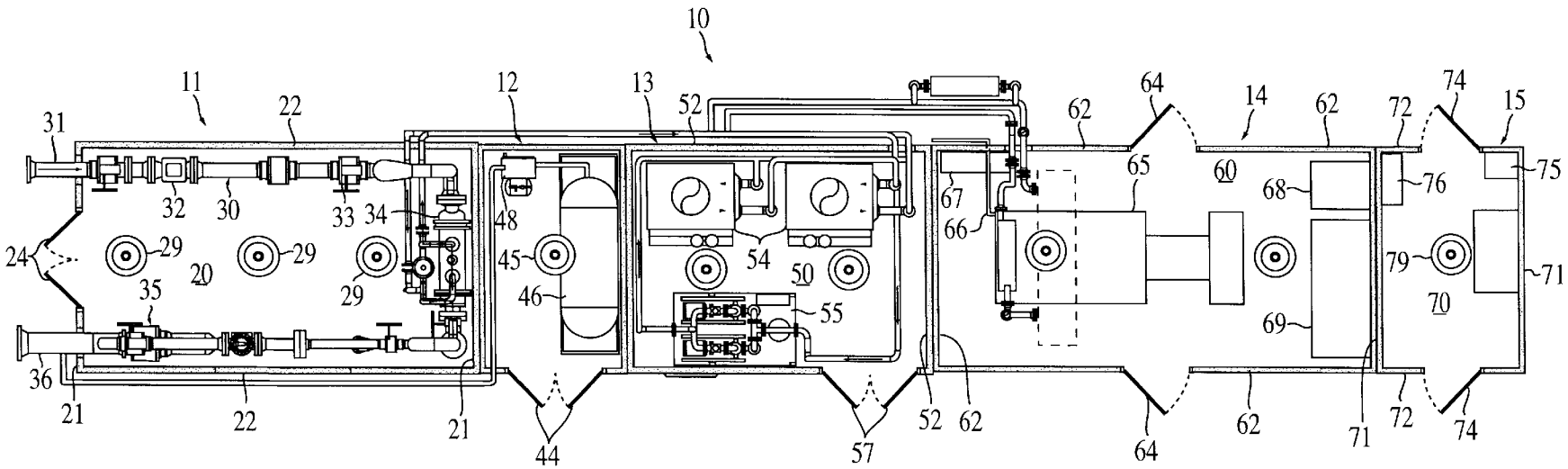
FIG. 2 is a top plan view of the pre-manufactured gas delivery station illustrated in FIG. 1 in accordance with the present invention.

Referring initially to FIGS. 1 and 2, a pre-manufactured gas delivery station 10 is illustrated in accordance with the present invention. Pre-manufactured gas delivery station 10 basically has five modules or modular rooms 11–15 that can be selectively coupled together at a factory site to form a single prefabricated building.

The natural gas delivery station 10 is low profile, odorless, quiet, and small. The pre-manufactured natural gas delivery station 10 can be constructed to be a single building that is 12 feet wide and 55 to 75 feet long. Preferably, the five modules or rooms 11–15 include a high pressure gas metering and regulating module or room 11, an odorant module or room 12, a gas heating module or room 13, an energy generation module or room 14 and an electrical control module or room 15. Of course, it will be apparent to those skilled in the art from this disclosure that additional modules can be utilized.

Documentation is prepared prior to manufacturing the customer selection of modules or rooms 11–15 and the individual pieces of equipment contained therein. This documentation also serves as submittal to Federal Energy Regulatory personnel and to the pipeline, end user, insurance inspector, and town building officials for pre-approval. This documentation can be quickly generated since each of the modules or rooms 11–15 will be completely and separately documented. Thus, the documentation for the gas delivery station 10 can be generated by combining the documentation of each version of the modules or rooms 11–15 that are selected. Because the same basic modules are used with each gas delivery station, the documentation will be familiar to the various individuals purchasing or approving the gas delivery station.

Each of the building rooms or modules 11–15 are designed to be prefabricated as separate rooms, which are assembled as a single prefabricated at a factory site and then transported to an installation site as seen in FIG. 1. In other words, each of the rooms or modules 11–15 is designed as a stand-alone unit that can be coupled in any order and/or combination with the other modules.

Figure 8:
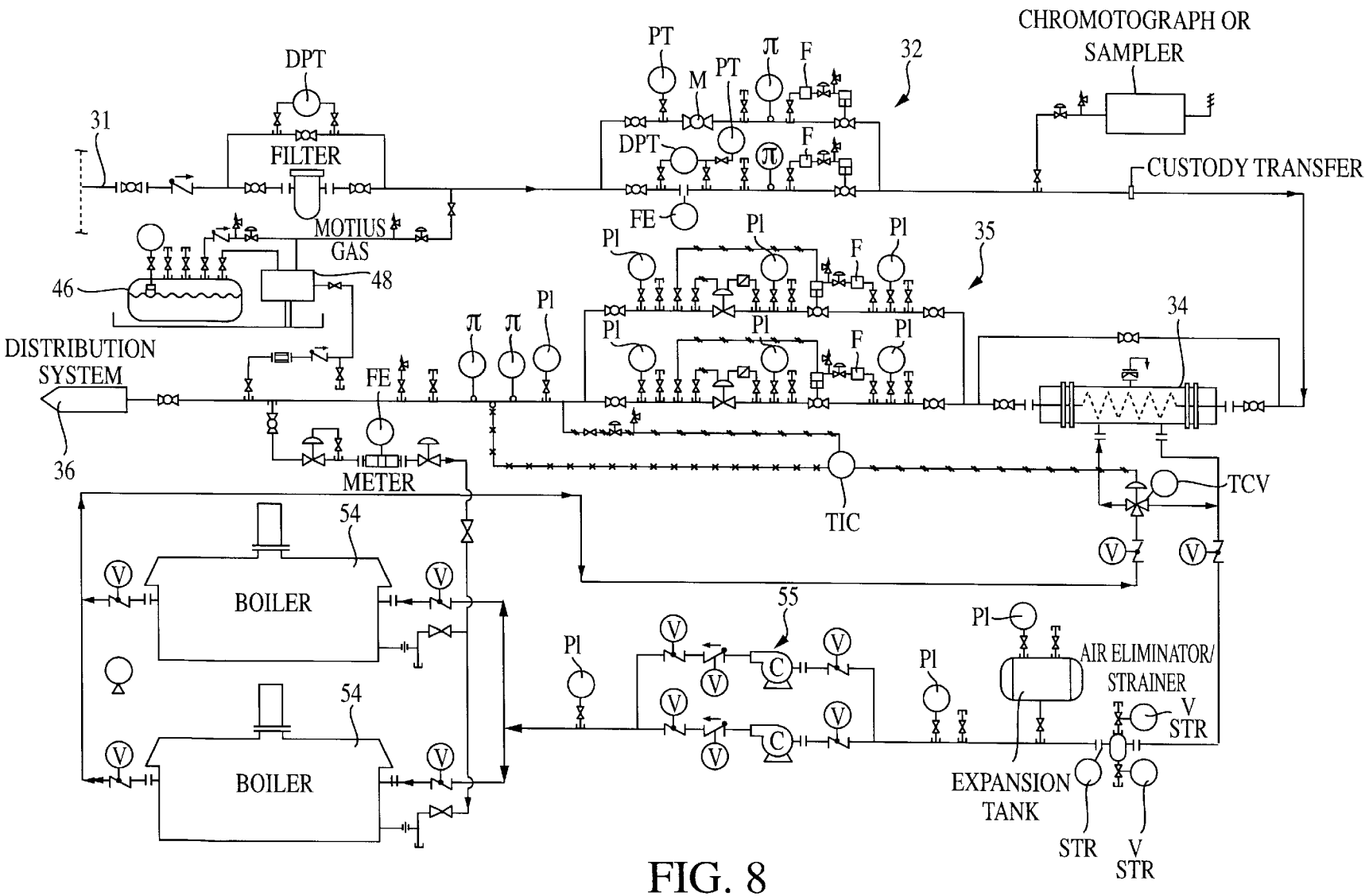
FIG. 8 is a schematic diagram for the pre-manufactured gas delivery station illustrated in FIGS. 1 and 2 in accordance with the present invention.
Figure 9:
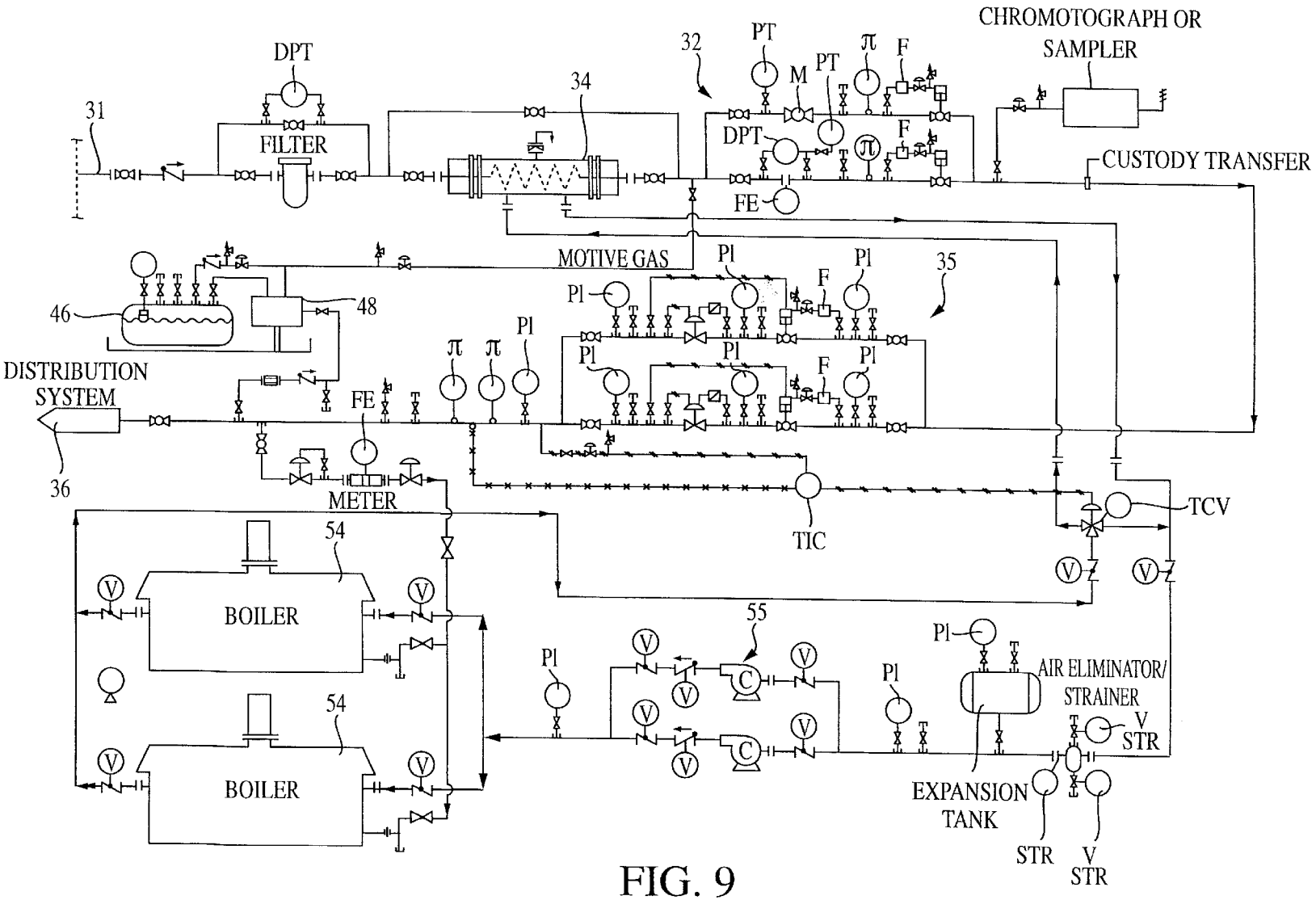
FIG. 9 is an alternate schematic diagram for the pre-manufactured gas delivery station illustrated in accordance with the present invention.

Generally speaking, prefabricating at a factory site, rooms 11–15 with standard equipment, carries out the method of prefabricating of gas delivery station 10 in accordance with the present invention. The basic building of gas delivery station 10 is the high pressure gas metering and regulating room 11. Several different versions of the high pressure gas metering and regulating room 11 can be prefabricated at the factory site to accommodate different requirements. For example, FIG. 8 illustrates one embodiment of the gas delivery station 10, and FIG. 9 illustrates another embodiment of the gas delivery station 10. In addition to the basic gas metering and regulating room 11, a predetermined set of modular rooms 12–15 is prefabricated at the factory site. These modular rooms 12–15 are configured to be coupled to the high pressure gas metering and regulating room 11 and each other to form a single unit. Preferably, these rooms 11–15 are combined together at the factory site in accordance with the customer's request. The rooms 11–15 can be fastened together utilizing conventional construction techniques, which are well known to those skilled in concrete construction.

While FIGS. 1 and 2 illustrate a gas delivery station 10 with all five modules or rooms 11–15, it will be apparent to those skilled in the art from this disclosure that any combination of rooms can be combine together to meet the customer's requirements. In other words, the high pressure gas metering and regulating room 11 can be combined with one or more of the modular rooms from the predetermined set of modular rooms 12–15 at the factory site to form a customer selected pre-manufactured gas delivery station. Moreover, the order or arrangement of the rooms 12–15 can be changed as required by the customer(s). Alternatively, two or more predetermined set of modular rooms 12–15 are combined together to form a building that can be used with a preexisting delivery station. Once the selected prefabricated rooms are fastened together at the factory to form a single building, the pre-manufactured gas delivery station selected by the customer is then shipped from the factory site to a customer installation site, which is remote from the factory site. Accordingly, the pre-manufactured gas delivery station 10 is easily installed at the installation site in considerably less time and with considerably less expense.

In the preferred embodiment, the customer is basically selecting one or more of the prefabricated modular buildings 11–15 which, as mentioned above, preferably includes high pressure gas metering and regulating room 11, odorant room 12, boiler room 13, energy generation room 14 and electrical control room 15. Of course, other modules or rooms can be included in the predetermined set of modular buildings from which the customer can create a pre-manufactured gas delivery station 10. Moreover, it is possible that in addition to the prefabricated rooms 11–15, the customer can request a custom build room or module, which is not one of the prefabricated rooms or modules. In other words, the customer can have a pre-manufactured gas delivery station 10 that includes both the prefabricated rooms or modules and completely customized rooms or modules. The prefabricated rooms or modules 11–15 are typically outfitted with certain basic equipment that is built into all similar prefabricated rooms or modules 11–15 as discussed below. Of course, additional custom features can be added to the basic or standard equipment of prefabricated rooms or modules 11–15 at the factory site or the installation site as needed and/or desired by the customer.

In accordance with another aspect of the present invention, pre-manufactured gas delivery station 10 is provided with energy generation room 14 so that pre-manufactured gas delivery station 10 can produce its own electrical energy. Basically, when station 10 has at least both the high pressure gas metering and regulating room 11 and the energy generation room 14, the station 10 will be able to operate either from an outside source of electrical energy or create its own electrical energy as explained below.

Preferably, the pre-manufactured gas delivery station 10 is installed on two reinforced concrete grade beams at the installation site. When the rooms or modules 11–15 are joined together, the resulting station 10 will be a complete integral waterproof building structure. The rooms or modules 11–15 can be fixedly coupled together using mortar or other fastening techniques such that station 10 can be shipped as a single building with multiple rooms. Each building module 11–15 is preferably of room-size dimensions such that it can easily contain the necessary and/or desired control system equipment, and personnel can easily move about therein. Preferably, the overall dimension of the assembled station 10 is approximately 55 to 75 feet long and 12 feet wide. While the final assembly of pre-manufactured gas delivery station 10 occurs at the factory site, it will be apparent to those skilled in the art from this disclosure that the various modules and/or equipment can be manufactured at other locations and transported to the factory site for final installation and assembly of station 10 before being shipped to the installation site.

At the factory site, all of the standard equipment, the electrical wiring and the piping are installed into each of the building modules 11–15. All of the equipment is preferably bolted down or otherwise secured within its particular building module or room so that it will remain at a fixed location therein during transportation. The various pieces of equipment that are installed in each of the modular rooms 11–15 are interwired and/or piped with one another at the factory site to form the pre-manufactured gas delivery station 10.

Preferably, all of the equipment installed in the building modules 11–15 is thoroughly tested at the factory site. This testing preferably includes individually testing all of the equipment as well as testing the equipment after the equipment is interconnected so as to operate as a single unit. All major and, if necessary, minor adjustments are preferably made at the factory so that minimal amount of adjustments will be needed at the installation site. As a result of prefabricating and pre-testing of the control system equipment, the pre-manufactured gas delivery station 10 is easily installed at the installation site in considerably less time and with considerably less expense.

Figure 3:
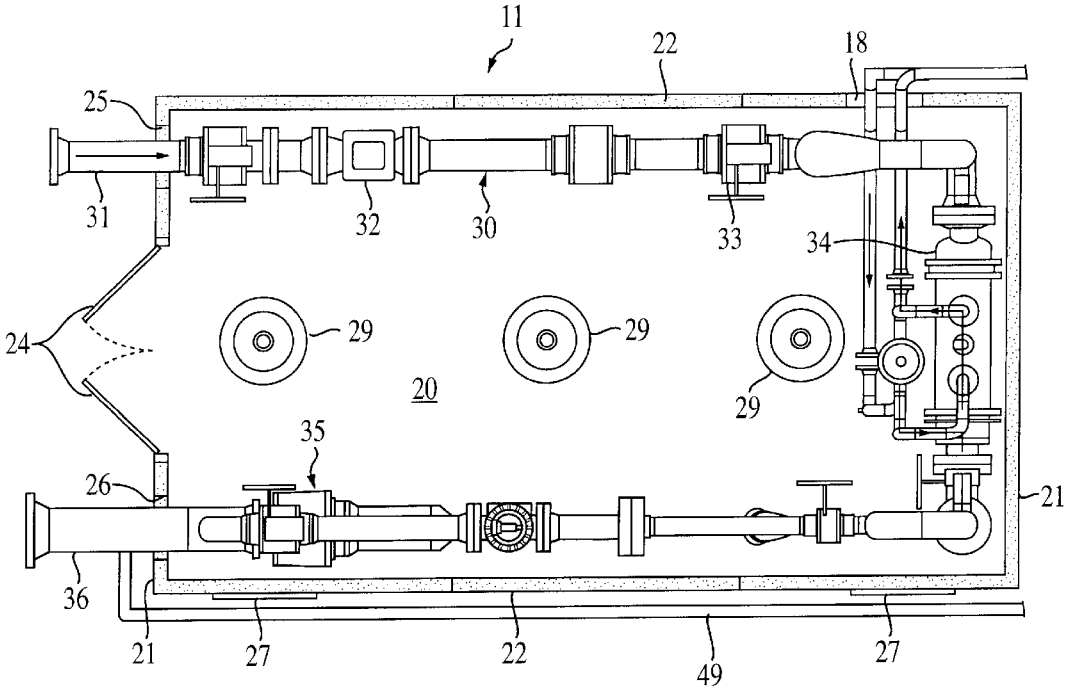
FIG. 3 is an enlarged, top plan view of the high pressure gas metering and regulating module or room illustrated in FIGS. 1 and 2 in accordance with the present invention.

As shown in FIGS. 1–3, the high pressure gas metering and regulating room 11 is preferably fabricated of concrete, which is designed to be fire-rated and gas impermeable in accordance with the industries' safety regulatory requirements. The phrase "fire-rated and gas impermeable" as used herein to refer to the construction of the walls of gas delivery station 10 means the existing fire rating requirements and gas impermeable rating requirements for walls of a gas metering station at the time of construction thereof.

As shown in FIGS. 1–3, high pressure gas metering and regulating room 11 basically has a flat base 20, a pair of flat end walls 21, a pair of flat side walls 22 and an angled roof 23, which together form a three-dimensional, rectangular building module. As mentioned above, high pressure gas metering and regulating room 11 can be fixedly coupled to the other rooms or modules 12–15 to form a single building. When two or more of the rooms or modules 11–15 are coupled together, the bases, the side walls and the roofs of the rooms or modules 11–15 are contiguous with the adjacent rooms or modules regardless of their order. Accordingly, high pressure gas metering and regulating room 11 is a three-dimensional module having substantially the same cross-sectional configuration as the other rooms or modules such that it can be mated with the other rooms or modules. In the preferred embodiment, this is accomplished by having end walls 21 of high pressure gas metering and regulating room 11 being substantially the same size and shape as the end walls of the other rooms or modules 12–15.

In the preferred embodiment, one of the end walls 21 is provided with a pair of doors 24 for accessing the interior of high pressure gas metering and regulating room 11. Doors 24 can be optionally provided with panic hardware if needed and/or desired. The other end wall 21 is designed to mate with any one of the other modules 12–15. The end wall 21 with doors 24 also has a pipe inlet opening 25 and a pipe outlet opening 26 so that the gas to be metered and/or regulated can enter and exit high pressure gas metering and regulating room 11. The side walls 22 can be provided with vents 27 for allowing fresh air to circulate therein. One of the side walls 22 preferably also has one or more access openings 28 for running piping and/or wires into high pressure gas metering and regulating room 11 from the other modules 12–15. The various electrical components and/or lighting fixtures 29 are mounted on the concrete end walls 21 and/or side walls 22 and/or roof 23 of high pressure gas metering and regulating room 11 in a conventional manner as needed and/or desired.

High pressure gas metering and regulating room 11 is preferably equipped with conventional metering and regulating equipment. Since such metering and regulating equipment is well known within the art, such metering and regulating equipment will not be discussed or illustrated in detail herein except for as it relates to the uniqueness of the present invention.

As seen in FIG. 2, a high pressure gas piping system 30 is installed within high pressure gas metering and regulating room 11 for metering and regulating gas such as natural gas from a first gas pipeline A to a second gas pipeline B, as seen in FIG. 1. More specifically, high pressure gas piping system 30 includes inlet piping 31 fixedly coupled to first gas pipeline, a high pressure gas metering unit 32, a flow control valve 33, a heat exchanger 34, a conventional regulating unit 35 and outlet piping 36. Of course, high pressure gas piping system 30 is provided with other piping and components which will not be discussed or illustrated in detail herein. For example, high pressure gas piping system 30 can include various gas bypass piping, pressure and temperature sensors, and other components that are well known in the natural gas industry.

The metering unit 32 is shown with an 8" Equimeter Auto-Adjust turbine meter. Of course, other types of metering units can be used. The metering unit 32 has a maximum rating of approximately 3,345 Mcfh at the inlet pressure of approximately 800 psig and a minimum rating of approximately 27.3 Mcfh at an inlet pressure of approximately 1200 psig. Dual outputs from main and correcting impellers of metering unit 32 are split and isolated with a Pepperl-Fuchs barrier. Standard electronic readouts will be provided to perform the adjustment calculations. Preferably, a flow control valve 33 is installed on the high pressure gas piping system 30. The flow control valve 33 can be, for example, an 8" Grove B-ball valve with a Becker actuator.

Figure 4:
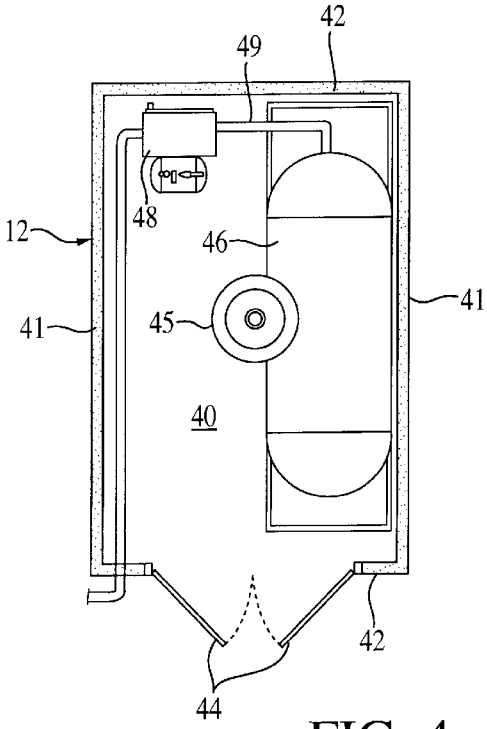
FIG. 4 is an enlarged, top plan view of the odorant module or room illustrated in FIGS. 1 and 2 in accordance with the present invention.

The high pressure gas metering and regulating room 11 is also preferably equipped with a forced ventilation system, which will be designed to provide fresh air to the high pressure gas metering and regulating room 11 several in an hour when activated. An explosion proof electric heater can also be installed to keep the high pressure gas metering and regulating room 11 above a predetermined temperature such as 50° F. Explosion proof incandescent lighting 29 can also be installed to provide an appropriate illumination level for the high pressure gas metering and regulating room 11, for example an illumination level of approximately 50 foot-candles. Referring now to FIGS. 1, 2 and 4, odorant room 12 is designed to add odor to the natural gas exiting the gas delivery station 10. Specifically, natural gas in its pure form is an odorless gas. Accordingly, odor is often added to natural gas so that the end user or consumer can smell the gas in the event of a gas leak. Accordingly, odorant room 12 can be added to the gas delivery station 10 when it is necessary to add an odor to the natural gas exiting the gas delivery station 10. Odorant room 12 basically includes a flat base 40, a pair of flat end walls 41, a pair of flat side walls 42 and an angled roof 43, which together form a three-dimensional, rectangular building module.

As shown in FIG. 1 and 2, end walls 41 are designed to mate with two of the other rooms or modules. For example, end walls 41 can be mated with one of the end walls 21 of high pressure gas metering and regulating room 11 and one of the end walls boiler room 13 to form a continuous integrated building. When high pressure gas metering and regulating room 11 and odorant room 12 are fixedly coupled together, side walls 42 of odorant room 12 form a continuous wall with side wall 22 of high pressure gas metering delivery room 11. Likewise, base 40 of odorant room 12 forms a continuous base with base 20 of high pressure gas metering and regulating room 11, and roof 43 of odorant room 12 forms a continuous roof with roof 23 of high pressure gas metering and regulating room 11. Odorant room 12 is preferably fabricated of concrete that is designed to be fire-rated and gas impermeable in accordance with the safety regulatory requirements for the industry. One of the side walls 42 is preferably provided with a pair of doors 44, which can be equipped with panic hardware. Also, one or more access openings are provided in one or both of the side walls 42 such that piping and/or wiring can be easily brought into or out of odorant room 12.

Odorant room 12 is preferably provided with an odorant tank 46 and an odor injection system 48. Odor injection system 48 is a conventional odor injection system that controls and regulates the odor being added to the natural gas. Since such odorant tanks and odor injection systems are well known within the art, odorant tank 46 and odor injection system 48 will not be discussed or illustrated in detail herein except for as it relates to the uniqueness of the present invention. Of course, it will be apparent to those skilled in the art from this disclosure that odorant room 12 can be provided with other piping and components which will not be discussed or illustrated herein.

Odor injection system 48 is fluidly coupled between odorant tank 46 and outlet piping 36 via piping 49. Piping 49 extends from odor injection system 46 out of odorant room 12 via an access opening and then runs along the exterior of high pressure gas metering and regulating room 11. Piping 49 is then coupled to outlet piping 36. Accordingly, no openings are formed in the end walls of either of high pressure gas metering and regulating room 11 or odorant room 12.

Odorant tank 46 and odor injection system 48 are fixedly secured to base 40 and/or end walls 41 and/or side walls 42 of odorant room 12 in a conventional manner. Likewise, the various electrical components and/or lighting fixtures 45 of odorant room 12 are mounted on the concrete end walls 41 and/or side walls 42 of odorant room 12 in a conventional manner as needed and/or desired.

Figure 5:
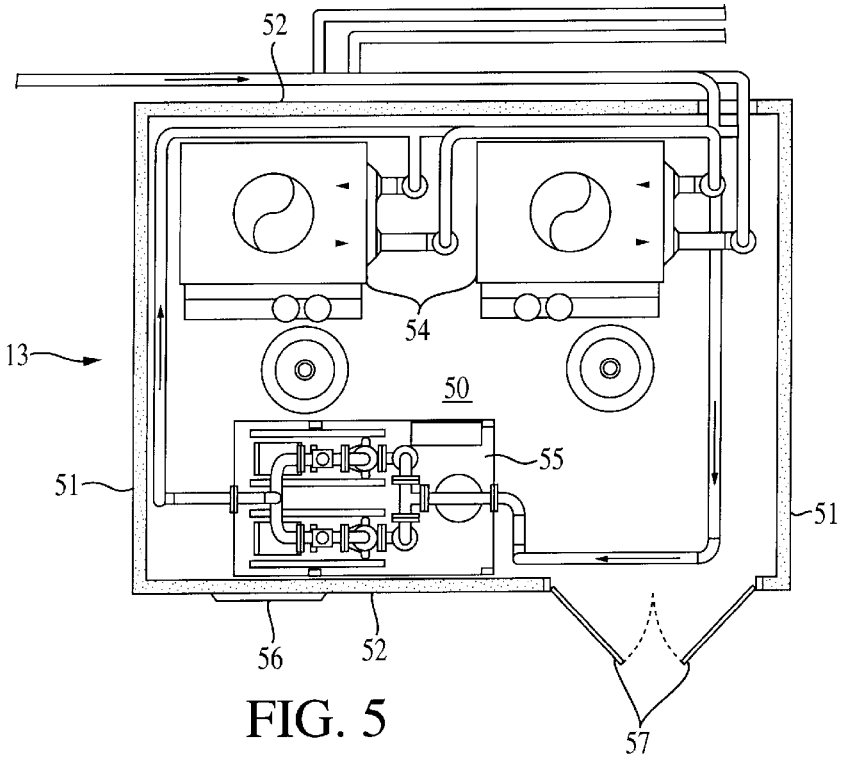
FIG. 5 is an enlarged, top plan view of the gas heating module or room illustrated in FIGS. 1 and 2 in accordance with the present invention.

Referring now to FIGS. 1, 2 and 5, boiler room 13 preferably includes a flat base 50, a pair of flat end walls 51, a pair of flat side walls 52 and an angled roof 53, which together form a three-dimensional, rectangular building module that can be fixedly coupled to other modules. Accordingly, boiler room 13 is a three-dimensional module having substantially the same cross-sectional configuration as the other rooms or modules such that it can be mated with the other rooms or modules. In other words, end walls 51 of boiler room 13 are sized and shaped to be mated with the end walls of one or more of the other rooms or modules 11, 12, 14 and 15. When boiler room 13 is fixedly coupled to the end walls of the other rooms or modules 11, 12, 14 and 15, a continuous integrated building is formed. The boiler room 13 is preferably fabricated of concrete that is designed to be fire-rated and gas impermeable in accordance with the safety regulations for the industry.

Boiler room 13 preferably includes a pair of heaters 54 and a pair of circulating pumps 55 coupled via piping to heat exchanger 34. Of course, it will be apparent to those skilled in the art from this disclosure that boiler room 13 can be provided with other standard or customized components which will not be discussed or illustrated herein. Heaters 54 are designed to transfer heat to the natural gas flowing through piping system 30 in a non-hazardous manner. Preferably, heaters 54 are propylene glycol/water heaters that are arranged in series with circulating pump 55.

By placing heaters 54 within a separate boiler room 13, noise to the surrounding environment can be minimized. In particular, the concrete walls 51 and 52 will reduce the amount of noise, which can be heard from gas delivery station 10. Moreover, noise attenuation devices and/or acoustical panels can be installed to walls 51 and 52 as needed and/or desired.

The propylene glycol/water heaters 54 preferably utilize natural gas at a pressure of 7–9" water column, with each having the maximum input of approximately 3,050,000 Btu/h for a total maximum usage of approximately 6.1 MMBtu/h. More specifically, heaters 54 and pump 55 are fluidly coupled to heat exchanger 34. The heat exchanger 34 is preferably a shell and tube heat exchanger with a three-way valve connected to the supply line and return line for heaters 54 and pump 55.

In the heat exchanger 34, natural gas enters one side of the inner tube of heat exchanger 34 at pipeline pressure, and glycol/water enters the shell of the heat exchanger 34 from the opposite side via the supply line. As the gas flows through the tube of the heat exchanger 34, the gas is heated by the glycol/water surrounding the outside of the inner tube and is preheated to a desired temperature. In other words, the glycol/water fluid is pumped through the heaters 54 to the heat exchanger 34 via pump 55 thereby warming the natural gas in the tubes. The glycol/water fluid is then returned to the heaters 54 via one or more pumps 55. A temperature controller mounted in the gas metering and regulating room 11 senses the downstream temperature. The temperature controller is preferably set to maintain a predetermined set point temperature of downstream gas such as 40° F. The temperature controller sends a signal to the three-way valve that controls the amount of fluid entering the heat exchanger 34 based on the downstream gas temperature. While heat exchanger 34 is located downstream of the metering unit 32 in FIGS. 2, 3 and 8, heat exchanger 34 can be located upstream of the metering unit 32 as seen in FIG. 9.

The benefit of placing the heat exchanger 34 upstream of the metering unit is that a more accurate measurement of the gas being withdrawn from the pipeline can be obtained. More specifically, sometimes the gas from the pipeline separates into two phases, i.e., a liquid phase and a vapor phase. This may result in an erroneous reading by the metering unit 32. By preheating the gas prior to entering metering unit 32, the system ensures that the gas is in its proper phase and at the proper temperature for accurately determining the amount of gas being withdrawn from the pipeline. In other words, this arrangement gives better control of all the conditions of the gas to be metered.

Heaters 54 preferably have aquastats and operate on water bath control. A backup aquastat can be provided to shut the unit off with a manual reset to reactivate heaters 54. Standard IRI burner controls provide high and low fuel pressure protection as well as double lock and lead protection. A low water cut off with manual reset is also preferably provided. A flow switch is preferably mounted on the inlet of each heater 54. A common trouble contact closure indicates problems on the unit that can activate a 24 volt DC signal as a digital input to the remote terminal unit located in electrical room 15. A 24 volt DC signal is then sent as a digital output from the remote terminal unit to shut the unit down. A combustible vapor detector and heat detector can also be installed in the boiler room 13.

Boiler room 13 is preferably provided with vents 56 to provide adequate combustion air without using power venting. The lighting level for this room is approximately 50 footcandles. The electrical control room 15 will also have an HVAC unit installed to maintain environment as needed for the equipment installed in the room. The lighting level for this room is approximately 50 footcandles. The doors 57 can be optionally equipped with panic hardware if needed and/or desired.

Figure 6:
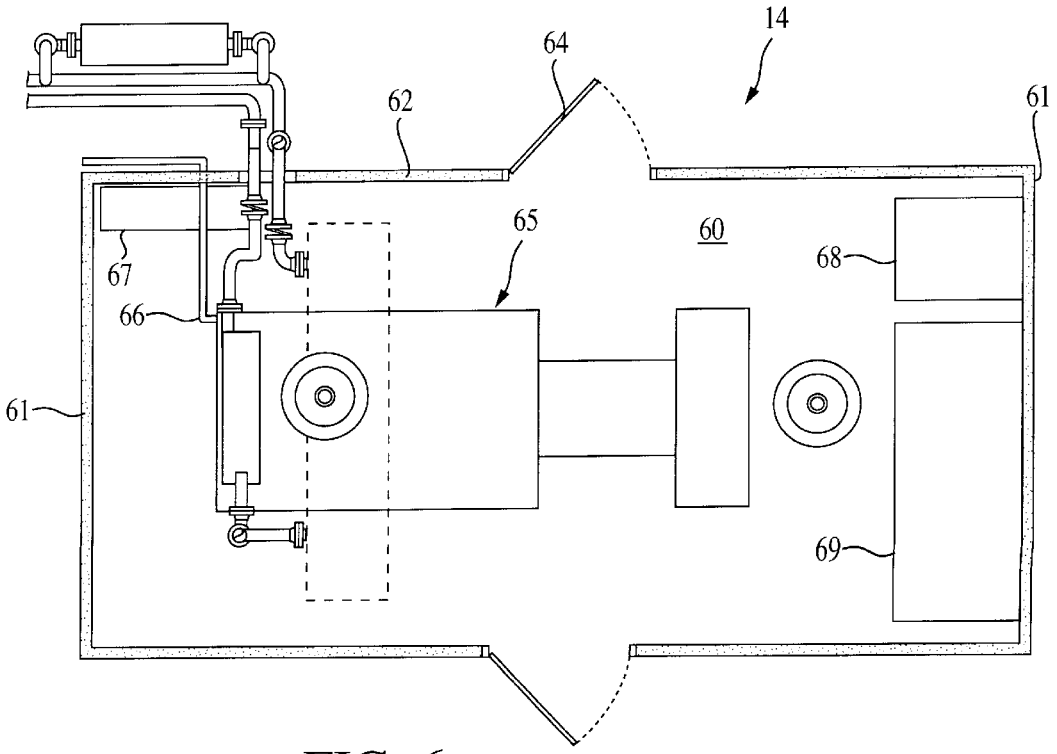
FIG. 6 is an enlarged, top plan view of the energy generation module or room illustrated in FIGS. 1 and 2 in accordance with the present invention.

Referring now to FIGS. 1, 2 and 6, energy generation room 14 basically includes a flat base 60, a pair of flat end walls 61, a pair of flat side walls 62 and an angled roof 63, which together form a three dimensional, rectangular building module. Accordingly, energy generation room 14 is a three-dimensional module having substantially the same cross-sectional configuration as the other rooms or modules such that it can be mated with the other rooms or modules. In other words, end walls 61 of energy generation room 14 are sized and shaped to be mated with the end walls of the other rooms or modules 11, 12, 13 and 15. When energy generation room 14 is fixedly coupled to the end walls of one or more of the other rooms or modules 11, 12, 13 and 15, a continuous integrated building is formed. The energy generation room 14 is preferably fabricated of concrete that is designed to be fire-rated and gas impermeable in accordance with the natural gas industries' safety regulatory requirements.

Each of the side walls 62 are preferably provided with a door 64 that can be equipped with panic hardware if needed and/or desired. Energy generation room 14 preferably includes a natural gas generator 65 which is fluidly coupled to high pressure gas piping system 30 such that natural gas generator 65 can operate on the natural gas which is being metered. Preferably, a natural gas supply line 66 runs from generator 65 to the downstream end of gas piping system 30 for supplying natural gas to generator 65. Supply line 66 preferably exits room 14 via the rear side wall 62 and then runs along the exterior of station 10. The supply line 66 then enters room 11 via access opening 28 for connection with gas piping system 30. Accordingly, gas metering station 10 is completely self-sufficient in that it can provide its own source of electrical power via generator 65.

Preferably, generator 65 is a 560 kW natural gas generator with a storage battery and charger unit 67 coupled thereto for storing and utilizing electrical energy generated from generator 65. Also, a generator control panel 68 and a utility interface panel 69 are also preferably mounted within energy generation room 14 and electrically coupled to gas generator 65 for controlling the electrical energy being supplied to gas metering station 10 via gas generator 65. Generator control panel 68 and utility interface panel 69 act together as a dual power control unit which allows the gas metering station to be operated either off of electrical energy provided from an electrical utility line or from generator 65. Of course, it will be apparent to those skilled in the art from this disclosure that energy generation room 14 can be provided with other components and/or lighting fixtures which will not be discussed or illustrated herein. For example, generator 65 can be provided with heat exchangers and pipings that are connected to the piping of the boiler room 13 to utilize heat produced by generator 65.

Figure 7:
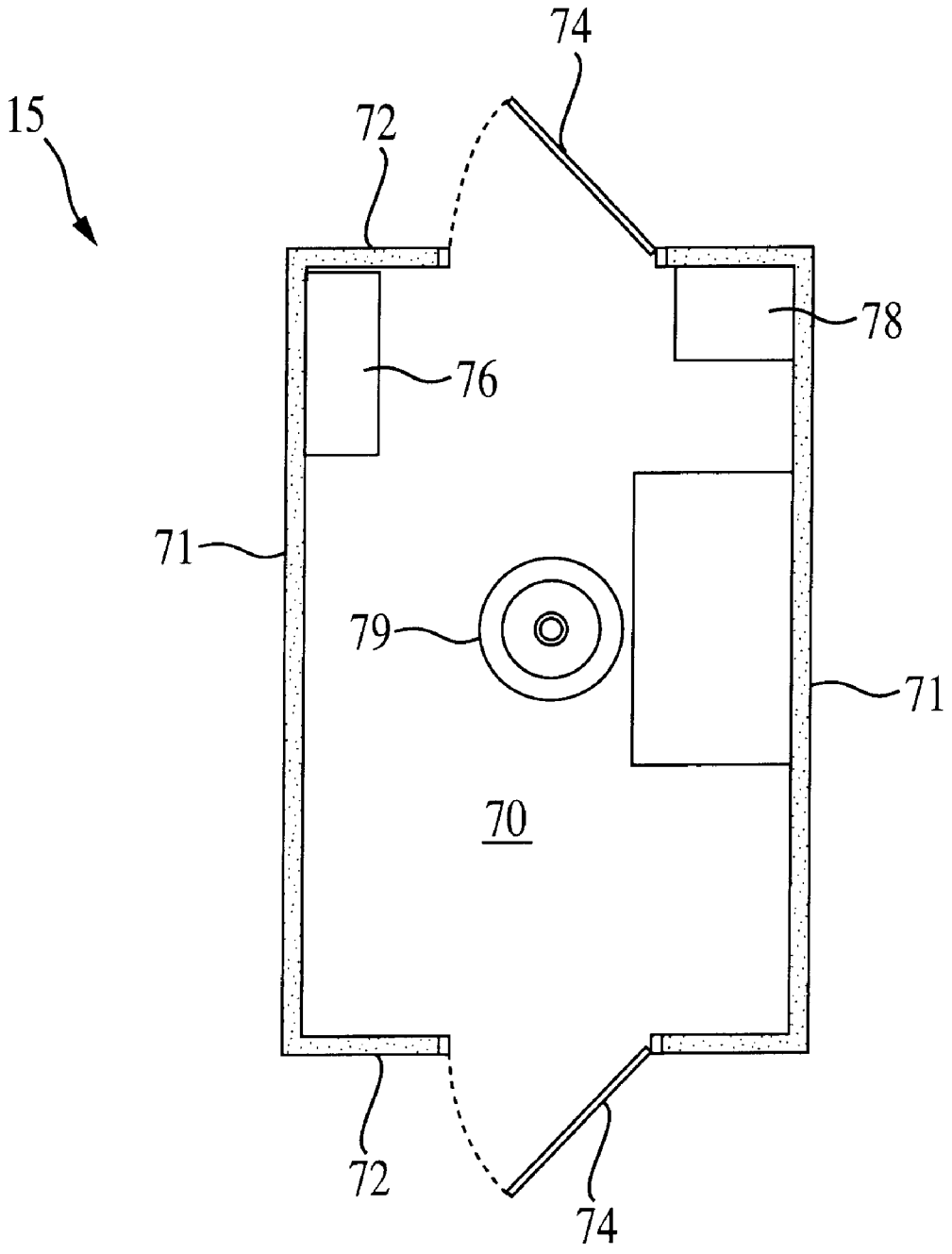
FIG. 7 is an enlarged, top plan view of an electrical control module or room illustrated in FIGS. 1 and 2 in accordance with the present invention.

Referring now to FIGS. 1, 2 and 7, electrical control room 15 is provided with conventional supervisory control and data acquisition (SCADA) equipment having communications equipment. The flow computer and SCADA interface for the supply pipeline and the end user reside in this room. The electrical control room 15 basically includes a base 70, a pair of end walls 71, a pair of side walls 72 and a roof 73, which together form a three dimensional, rectangular building module. Accordingly, electrical control room 15 is a three-dimensional module having substantially the same cross-sectional configuration as the other rooms or modules such that it can be mated with the other rooms or modules. In other words, end walls 71 of being sized and shaped to be mated with the end walls of the other rooms or modules 11, 12, 13 and 14. When electrical control room 15 is fixedly coupled to the end walls of the other rooms or modules 11, 12, 13 and 14, a continuous integrated building is formed.

The electrical control room 15 is preferably fabricated of concrete that is designed to be fire-proof and gas impermeable in accordance with the natural gas industries' safety regulatory requirements.

Each of the side walls 72 preferably has a door 74 for accessing electrical control room 15. Electrical control room 15 is preferably provided with standard electrical equipment, including an electrical service unit 75 which is designed to be a 277/480 volt, three phase, 200 amp service. The electrical service unit 75 can be provided with a transfer switch to allow for addition of on-site electrical generation either permanent or temporary. An uninterrupted power source (UPS) 76 is also preferably provided to supply standby power to the emergency instruments and control devices for eight hours, and emergency lighting for a minimum of fifteen minutes. The non-hazardous electrical control room 15 contains the electrical service termination at the breaker panel, an electric meter, and voice and data telephone for the pre-manufactured gas delivery station 10. Of course, it will be apparent to those skilled in the art from this disclosure that electrical control room 15 can be provided with other electrical components such as a remote terminal unit.

The electrical design for the pre-manufactured gas delivery station 10 is based on a hazardous designation for the high pressure gas metering and regulating room 11 and a non-hazardous destination for the remaining rooms, i.e., the odorant room 12, the boiler room 13, the energy generation room 14 and the electrical control room 15. The flow controllers as well as the explosion-proof transmitters are installed in the hazardous area to control the valves and to send back the pre-requisite, temperature and flow information to the remote terminal unit which is connected to electrical control room 15. Explosion-proof and incandescent lighting and outlets are installed in the hazardous areas. The power and controllers for all of the rooms or modules 11–15 are provided by the electrical control room 15. The glycol/water pump 55 and the glycol/water heaters 54 are also located in a non-hazardous room and are wired with standard non-hazardous fittings and controls. The pump 55 operates on 208, three-phase for power, while the heaters 54 requires 120 volt AC for power. The electrical control room 15 also contains non-hazardous incandescent lighting fixtures 79 and outlets in addition to a combustible gas detector.

As previously mentioned, a basic concept of the present invention is to create a pre-manufactured gas delivery station at relatively low costs and more quickly than if built at the installation site. This method of the present invention requires a predetermined set of modular buildings 11–15 to be prefabricated at a factory site for constructing the building that either forms a pre-manufactured gas delivery station 10 or forms part of an existing gas delivery station. As mentioned above, these modular buildings 11–15 are configured to be coupled together to form a single integrated unit. In the preferred embodiment, the predetermined set of modular buildings 11–15 includes at least a high pressure gas metering and regulating room 11, an odorant room 12, a boiler room 13, an energy generation room 14, and an electrical control room 15. These modular rooms 11–15 are combined at the factory site such that at least one of the predetermined set of modular rooms 11–15 is combined with at least one other of the predetermined set of modular rooms 11–15 at the factory site to form a customer selected building. Once the rooms are assembled, the building is shipped from the factory site to the installation site, which is remote from the factory site.

In accordance with this method of the present invention, the customer can select predetermined set of modular rooms which preferably includes a high pressure gas regulating and metering room, an odorant room, a boiler room, an energy generation room and an electrical control room. Of course, other modules or rooms can be included in the predetermined set of modular buildings 11–15 from which the customer can create the pre-manufactured gas delivery station 10. Moreover, it is possible that a module can be constructed which is not one of the prefabricated modules. In other words, the customer can have a pre-manufactured gas delivery station 10 that includes both the prefabricated modules and completely customized modules. The prefabricated rooms or modules are typically outfitted such that certain basic equipment is built into all similar prefabricated rooms or modules. Of course, additional custom features can be added to the basic prefabricated rooms or modules at the factory site as needed and/or desired by the customer.

The building modules are loaded with control system equipment and thoroughly tested at the factory site to ensure that all systems are operational. Thereafter, the fully prefabricated gas delivery station 10 is transported to the industrial or commercial installation site and installed at such installation site utilizing conventional techniques. Gas delivery stations 10 constructed in accordance with the present invention can be used in a wide variety of applications, which require the use of relatively complex electrical and electronic equipment. As indicated above, the present invention can be used to erect a fully equipped ready-to-operate gas metering station with minimal time and labor at the installation site. The present invention affords substantial advantages and savings in that a very large portion of the equipment installation work, equipment adjustment work and testing is efficiently and economically performed at the factory or manufacturing site which is better equipped and better staffed to manufacture the gas metering station.

At the factory site, the equipment, the electrical wiring and the piping are all installed into each of the building modules 11–15. All of the equipment is preferably bolted down or otherwise secured within its particular building module or room so that it will remain at a fixed location therein during transportation. The various pieces of equipment that are installed in each of the building units are interwired and/or piped with one another at the factory site to form the gas delivery station 10. All of the equipment installed in the building modules 11–15 are thoroughly tested at the factory site. This testing includes combined testing of the equipment interconnected so as to operate as a single unit. All major and, if necessary, minor control equipment adjustments are preferably made at the factory so that minimal amount of adjustments will be needed at the installation site.

While only one embodiment has been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. A pre-manufactured natural gas delivery station, comprising:

a high pressure gas metering and regulating room having high pressure gas piping with a gas inlet adapted to be coupled to a first gas pipeline and a gas outlet adapted to be coupled to a second gas pipeline, said high pressure gas piping having a high pressure gas metering unit, regulating equipment, and a heat exchanger coupled between said gas inlet and said gas outlet;

a generation room with a gas operated generator with a gas conduit fluidly coupling said high pressure gas piping to said gas operated generator; and a dual power control unit electrically coupled to said gas operated generator to receive electrical energy therefrom and configure to be electrically coupled to an electrical utility line for receiving electrical energy therefrom.

2. A pre-manufactured natural gas delivery station according to claim 1, wherein an odorant room is fixedly coupled to said high pressure gas metering and regulating room.

3. A pre-manufactured natural gas delivery station according to claim 1, wherein a boiler room is fixedly coupled to said high pressure gas metering and regulating room.

4. A pre-manufactured natural gas delivery station according to claim 1, wherein an electrical control room is fixedly coupled to said high pressure gas metering and regulating room.

5. A pre-manufactured natural gas delivery station according to claim 1, wherein an odorant room, a boiler room and an electrical control room are fixedly coupled to said high pressure gas metering and regulating room.

6. A pre-manufactured natural gas delivery station according to claim 5, wherein each of said high pressure gas metering and regulating room, said generation room, said odorant room, said boiler room and said electrical control room has a pair of side walls and a pair of end walls, with said end walls of said rooms being adapted to mate with one of said end walls of the other of said rooms.

7. A pre-manufactured natural gas delivery station according to claim 6, wherein each of said end walls of each of said rooms being constructed to be gas impermeable and fire rated.

8. A pre-manufactured natural gas delivery station according to claim 6, wherein said odorant room has an odorant tank with an odorant line fluidly coupled to said high pressure gas piping to add odorant thereto.

9. A pre-manufactured natural gas delivery station according to claim 8, wherein said odorant line extends along an exterior portion of said odorant room and said high pressure gas metering and regulating room.

10. A pre-manufactured natural gas delivery station according to claim 6, wherein said boiler room includes at least one heater unit with a supply line and a return line, and said high pressure gas metering and regulating room includes a heat exchanger fluidly coupled to said supply line and said return line, in series with a glycol water three way valve which modulates water to the heat exchanger or back to the heater room based upon gas temperature with said heat exchanger being positioned to heat said high pressure gas piping.

11. A pre-manufactured natural gas delivery station according to claim 10, wherein said electrical control room includes computer equipment adapted to be electrically coupled to said high pressure gas metering unit to monitor and control operations of said pre-manufactured natural gas delivery station.

12. A method of prefabricating a pre-manufactured natural gas delivery station, comprising the steps of:

preparing documentation prior to manufacturing which illustrates the customer selection of a high pressure gas metering and regulating room, a predetermined set of modular buildings and individual pieces of equipment;

pre-fabricating at a factory site said high pressure gas metering and regulating room having high pressure gas piping with a gas inlet adapted to be coupled to a first gas transmission pipeline and a gas outlet adapted to be coupled to a gas distribution pipeline, said high pressure gas piping having a high pressure gas metering unit, a gas pressure regulation unit, and a heat exchanger coupled between said gas inlet and said gas outlet;

prefabricating at said factory site a predetermined set of modular buildings that are configured to be coupled to said high pressure gas metering and regulating room;

combining at said factory site said high pressure gas metering and regulating room with at least one of said predetermined set of modular buildings at said factory site to form a customer selected pre-manufactured natural gas delivery station; and shipping said customer selected gas pre-manufactured gas delivery station from said factory site to a customer installation site, which is remote from said factory site.

13. A method of prefabricating a pre-manufactured gas delivery station according to claim 12, wherein said predetermined set of modular buildings includes an odorant room fixedly coupled to said high pressure gas metering and regulating room at said factory site, said odorant room includes an odorant tank fluidly coupled to said high pressure gas piping.

14. A method of prefabricating a pre-manufactured gas delivery station according to claim 12, wherein said predetermined set of modular buildings includes a boiler room fixedly coupled to said high pressure gas metering and regulating room at said factory site, said boiler room includes a remote heater operatively coupled to said high pressure gas piping via a heat exchanger.

15. A method of prefabricating a pre-manufactured gas delivery station according to claim 12, wherein said predetermined set of modular buildings includes an energy generation room fixedly coupled to said high pressure gas metering and regulating room at said factory site, said energy generation room includes a natural gas generator that is fluidly coupled to said high pressure gas piping to supply natural gas thereto.

16. A method of prefabricating a pre-manufactured gas delivery station according to claim 12, wherein said predetermined set of modular buildings includes an electrical control room fixedly coupled to said high pressure gas metering and regulating room at said factory site, said electrical control room includes supervisory control and data acquisition equipment and an electrical service unit.

17. A method of prefabricating a pre-manufactured gas delivery station according to claims 12, wherein said predetermined set of modular buildings includes an odorant room, a boiler room, an energy generation room and an electrical control room.

18. A method of prefabricating a pre-manufactured gas delivery station according to claim 17, wherein said energy generation room has a gas operated generator with a gas conduit adapted to be fluidly coupled to said high pressure gas piping.

19. A method of prefabricating a pre-manufactured gas delivery station according to claim 18, wherein said gas operated generator has a dual power control unit electrically coupled thereto for receiving electrical energy therefrom and configured to be electrically coupled to an electrical utility line for receiving electrical energy therefrom.

20. A method of prefabricating a pre-manufactured gas delivery station according to claim 17, wherein each of said rooms of said predetermined set of buildings includes a pair of side walls and a pair of end walls, with said end walls of said rooms being adapted to mate with an end wall of said high pressure gas metering and regulating room.

21. A method of prefabricating a pre-manufactured gas delivery station according to claim 20, wherein each of said end walls of each of said rooms being fire rated and gas impermeable walls.

22. A method of prefabricating a pre-manufactured gas delivery station according to claim 17, wherein said odorant room has an odorant tank with an odorant line fluidly coupled to said high pressure gas piping to add odorant thereto.

23. A method of prefabricating a pre-manufactured gas delivery station according to claim 22, wherein said odorant line extends along an exterior portion of said odorant room and said high pressure gas metering and regulating room.

24. A method of prefabricating a pre-manufactured gas delivery station according to claim 17, wherein said boiler room includes at least one heater unit with a supply line and a return line, and said high pressure gas metering and regulating room includes a heat exchanger fluidly coupled to said supply line and said return line, with said heat exchanger being positioned to transfer heat to said high pressure gas piping.

25. A method of prefabricating a pre-manufactured gas delivery station according to claim 24, wherein coupling said heat exchanger to said high pressure gas piping between said gas inlet and said high pressure gas metering unit.

26. A method of prefabricating a pre-manufactured gas delivery station according to claims 24, wherein coupling said heat exchanger to said high pressure gas piping between said pressure gas metering unit and said gas outlet.

27. A method of prefabricating a pre-manufactured gas delivery station according to claim 17, wherein said electrical control room includes electronic monitoring equipment adapted to be electrically coupled to said high pressure gas metering unit to monitor and control operations of said pre-manufactured gas delivery station.

28. A method of prefabricating a pre-manufactured gas delivery station according to claim 12, further comprising the step of submitting documentation to regulatory authorities.

29. A method of prefabricating a pre-manufactured gas delivery station according to claim 12, wherein connecting said gas inlet to a supply line and said gas outlet to a distribution line.

30. A method of prefabricating buildings for gas delivery stations, comprising the steps of:

prefabricating at a factory site a predetermined set of modular buildings for pre-manufactured gas delivery stations that are configured to be coupled together, said predetermined set of modular buildings including at least an odorant room with an odorant tank, a boiler room with a remote heater, an energy generation room with a gas operated generator, an electrical control room with supervisory control and data acquisition equipment and a high pressure gas metering and regulating room with a high pressure gas metering unit;

combining at said factory site at least one of said predetermined set of modular buildings with at least one other of said predetermined set of modular buildings at said factory site to form a customer selected building; and shipping said customer selected building from said factory site to a customer installation site, which is remote from said factory site.

31. A method of prefabricating buildings for gas delivery stations according to claim 30, further comprising the step of installing in said high pressure gas metering and regulating room at said factory site high pressure gas piping with a gas inlet adapted to be coupled to a first gas transmission line and a gas outlet adapted to be coupled to a gas distribution line, said high pressure gas piping having said high pressure gas metering unit, a gas pressure regulation unit, a a heat exchanger coupled between said gas inlet and said gas outlet.

32. A method of prefabricating buildings for gas delivery stations according to claim 31, further comprising the step of installing in said odorant room at said factory site an odor control system with a supply line coupling said odorant tank to said high pressure gas piping.

33. A method of prefabricating buildings for gas delivery stations according to claim 31, further comprising the steps of installing in said boiler room at said factory site a recirculating pump with a supply line and a return line coupled between said heater and said heat exchanger, and coupling to said supply line and said return line in series with a glycol water three way valve which modulates water between said heat exchanger and said heater based upon gas temperature, with said heat exchanger being positioned to transfer heat to said high pressure gas piping.

34. A method of prefabricating buildings for gas delivery stations according to claim 33, further comprising the step of coupling said heat exchanger to said high pressure gas piping between said gas inlet and said high pressure gas metering unit.

35. A method of prefabricating buildings for gas delivery stations according to claim 31, further comprising the step of electrically coupling said supervisory control and data acquisition equipment to said high pressure gas metering unit and said gas pressure regulation unit to monitor and control operations thereof.

36. A method of prefabricating buildings for gas delivery stations according to claim 30, wherein said predetermined set of modular buildings includes an odorant room fixedly coupled to said high pressure gas metering and regulating room at said factory site.

37. A method of prefabricating buildings for gas delivery stations according to claim 30, wherein said boiler room is fixedly coupled to said high pressure gas metering and regulating room at said factory site.

38. A method of prefabricating buildings for gas delivery stations according to claim 30, wherein said energy generation room is fixedly coupled to said high pressure gas metering room at said factory site.

39. A method of prefabricating buildings for gas delivery stations according to claim 30, wherein said predetermined set of modular buildings includes an electrical control room is fixedly coupled to said high pressure gas metering and regulating room at said factory site.

40. A method of prefabricating buildings for gas delivery stations according to claim 34, wherein said gas operated generator has a dual power control unit electrically coupled thereto for receiving electrical energy therefrom and configured to be electrically coupled to an electrical utility line for receiving electrical energy therefrom.

41. A method of prefabricating buildings for gas delivery stations according to claim 30, wherein each of said rooms of said predetermined set of buildings includes a pair of side walls and a pair of end walls, with said end walls of said rooms being adapted to mate with an end wall of said high pressure metering and regulating room.

42. A method of prefabricating buildings for gas delivery station according to claim 41, wherein each of said end walls of each of said rooms being fire rated and gas impermeable walls.

43. A method of prefabricating buildings for gas delivery station according to claim 30, wherein preparing documentation prior to manufacturing which illustrates the customer selection of said high pressure gas metering room, said predetermined set of modular buildings and individual pieces of equipment.

44. A method of prefabricating buildings for gas delivery station according to claim 43, wherein submitting said documentation to regulatory authorities.

45. A method of prefabricating buildings for gas delivery station according to claim 30, wherein connecting said gas inlet to a supply line and said gas outlet to a distribution line.

* * * * *